United States Patent [19]

McBeath et al.

[11] Patent Number: 4,929,933

[45] Date of Patent: May 29, 1990

[54] DIGITAL COLOR VIDEO MONITOR

[75] Inventors: Les L. McBeath, Elmhurst; Amir M. Sheikholeslami, Arlington Heights; Glenn T. Turro, Oak Park, all of Ill.

[73] Assignee: Zenith Electronics Corporations, Glenview, Ill.

[21] Appl. No.: 79,369

[22] Filed: Jul. 30, 1987

[51] Int. Cl.[5] ..... G09G 1/28

[52] U.S. Cl. ..... 340/703; 340/701; 340/709; 340/790

[58] Field of Search ..... 340/703, 721, 720, 723, 340/750, 747, 798, 799, 790

[56] References Cited

U.S. PATENT DOCUMENTS

| | | | |
|---|---|---|---|
| 4,149,184 | 4/1979 | Giddings et al. | 340/703 |
| 4,180,805 | 12/1979 | Burson | 340/709 |
| 4,429,306 | 1/1984 | Macauley et al. | 340/790 |
| 4,631,691 | 12/1986 | Pica | 340/728 |
| 4,641,282 | 2/1987 | Ounuma | 340/703 |
| 4,673,930 | 6/1987 | Bujalski | 340/721 |
| 4,684,935 | 8/1987 | Fujisaku et al. | 340/721 |

*Primary Examiner*—Gerald L. Brigance

[57] ABSTRACT

A video monitor operable in either a 16 or 64 color mode includes a PROM having logic level color video inputs and logic level function inputs, including a mode select input, for accessing different memory locations at each of which binary data is stored for activating a plurality of logic level color video outputs. A plurality of analog R, G and B processing circuits are coupled to the PROM outputs, with their gains being controlled by the color video signals supplied from open collector connected outputs in the PROM. The gains are user adjustable by means of logic level driven analog circuits. The horizontal scan frequency differs in the two modes and a mode switched brightness compensation output is provided by the PROM.

8 Claims, 1 Drawing Sheet

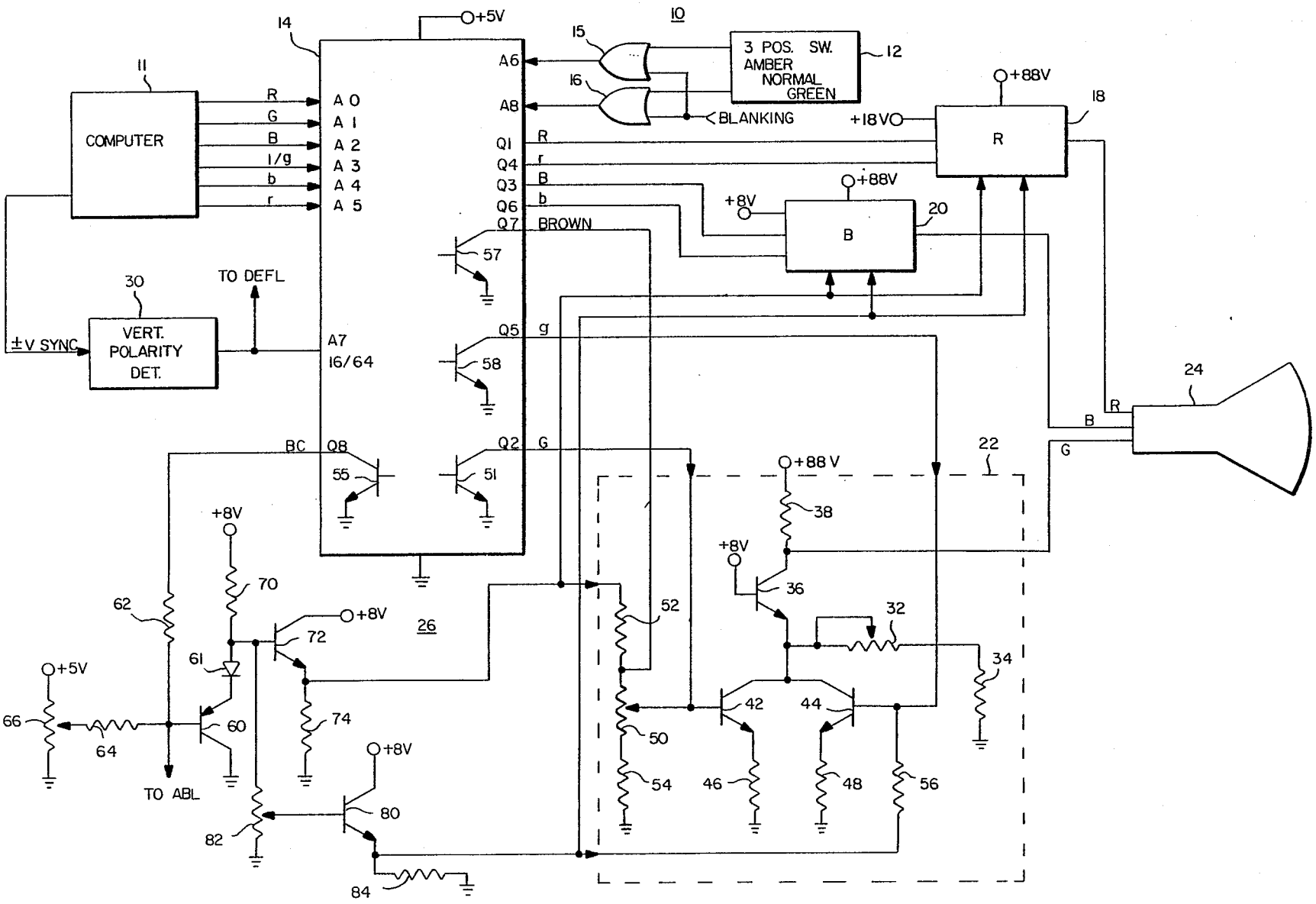
3 POS. SW.
AMBER
NORMAL
GREEN
BLANKING
+18V
+88V
+8V
+5V
R
B
G
BROWN
COMPUTER
VERT. POLARITY DET.
±V SYNC
TO DEFL
TO ABL
A0
A1
A2
A3
A4
A5
A6
A7
A8
Q1
Q2
Q3
Q4
Q5
Q6
Q7
Q8
16/64
I/g
BC

DIGITAL COLOR VIDEO MONITOR

BACKGROUND OF THE INVENTION AND PRIOR ART

This invention relates in general to color video monitors capable of accepting digital color input signals and particularly to a color video monitor that is capable of accepting signals formatted in different modes.

The rapid proliferation of color video monitors for use with computers having digital outputs has resulted in a number of different video color format schemes or modes, hereinafter referred to simply as formats or modes. For example, it is known to have a 16 color video format coupled with a horizontal scanning frequency of 15.75 KHz and a 64 color video format coupled with a 21.8 KHz scanning frequency. Other formats are also used and still others will certainly be provided in the future. It is also desirable to provide means for developing a monochromatic display, generally in either green or amber, in many applications to satisfy viewer's preferences. The IBM Corporation has also developed a distinctive video brown known as "IBM brown" for certain of its monitors and it is also desirable to be able to produce this video color on the CRT.

The commonly known 16 color format includes red (R), green (G) and blue (B) color signals and a common intensity (I) signal. The 64 color format has R, G and B color signals and red (r), green (g) and blue (b) individually intensity signals. The horizontal scanning frequency for the 16 color format is lower than that for the 64 color format and the polarity of the incomihg vertical synchronizing signal is used to identify the mode being used, i.e., 16 or 64 color. Additionally, it is desirable to provide the viewer with a control to adjust the overall brightness and contrast of the video display to his preference.

The monitor of the invention automatically adjusts for the color mode (in the preferred embodiment, either a 16 or 64 color format) and conditions the monitor operating circuits to function therewith. This is accomplished by means of a Programmable Read Only Memory (PROM) that has a plurality of video color inputs and functional inputs and a plurality of outputs with input addressable memory locations at which are stored binary words for supplying appropriate information to the outputs.

OBJECTS OF THE INVENTION

The principal object of the invention is to provide a novel color video monitor.

Another object of the invention is to provide a color video monitor that is automatically conditioned by incoming information for operation with different color video formats.

A further object of the invention is to provide a multimode color video monitor that is economical to manufacture.

BRIEF DESCRIPTION OF THE DRAWING

These and other objects and advantages of the invention will be apparent upon reading the following description in conjunction with the drawing, the single FIGURE of which is a partial block, partial schematic representation of a color video monitor constructed in accordance with the invention.

DESCRIPTION OF THE PREFERRED EMBODIMENT

Referring to the drawing, a color video monitor, generally designated 10, includes a plurality of color signal input terminals A0–A5 and function input terminals A6–A8 for receiving a corresponding plurality of digital video input signals and functional input signals, respectively. The signals may be from any suitable source, such as a computer 11. The video input terminals and functional input terminals correspond to address inputs of a PROM 14. PROM 14 includes a plurality of memory output terminals Q1–Q8 that supply digital logic level signals for controlling displayed video information on the cathode ray tube (CRT) 24 of the monitor. The digital video input signals supplied to PROM 14 are R, G and B and I/g, b, r (at terminals A0–A5), a mode select signal (at terminal A7) and a pair of signals for controlling blanking and the color mode of the CRT display (at terminals A6 and A8). This latter function is controlled by a 3-position switch 12 that is user actuatable among "normal," "amber" and "green" positions. The RGB input signals relate to the primary colors R, G and B, whereas the r, g and b and I input signals relate to the brightness or intensity of the corresponding primary colors and overall display, respectively. When the display is supplied with input signals formatted in the 16 color mode, R, G, B and I are used, whereas when it is supplied with signals formatted in the 64 color mode, R, G, B, r, g and b are used. I and g share the A3 input terminal. The functional signal inputs will be discussed hereinafter.

The digital signals at the outputs of PROM 14 comprise R, G, B I, r, g, b and a Brown (for IBM brown) and a brightness compensation (BC) signal. The R and r signals are applied to R processing means 18, the B and b signals to B processing means 20 and the G and g signals to G processing means 22, shown in schematic form and enclosed by dashed lines. The outputs of the R, G and B processing means are applied to respective cathodes of CRT 24. The Brown signal is applied to G processing means 22 and the BC signal is applied to a user adjustment means 26 for enabling control of the CRT brightness and contrast.

The functional input terminals A6 and A8 of PROM 14 are supplied from the outputs of a pair of OR gates 15 and 16. The inputs to the ORs are supplied from switch 12 and a source of composite blanking signals (not shown). Movement of switch 12 among its positions, in conjunction with the blanking pulses, results in the A6 and A8 input terminals of PROM 14 being at the same low logic level (O) for a normal display and at opposite levels for a monochrome green or amber display, irrespecitve of the colors actually being received and at high levels during blanking.

As will be explained, brightness compensation is provided since it has been found that a monitor that is operated at 15.75 KHz tends to appear less bright (in the display area) than when it is opoerated at 21.8 KHz. The BC signal is used to change the brightness when operating in one color mode so that the brightness in both color modes is substantially the same.

Vertical sync input signals are applied to a vertical polarity detector circuit 30. The polarity of the incoming vertical sync is used to identify the color mode or format of the video signals. Polarity circuit 30 determines the polarity of the vertical sync signal and provides a high or low logic level signal to the A7 (mode select) input terminal of PROM 14 to select the 16 or 64 color mode. It also supplies a similar signal to a vertical deflection circuit (not shown) to assure that the vertical sync pulses developed for the monitor deflection circuits are of proper polarity irrespective of the polarity of the incoming vertical sync. The vertical polarity detector 30 may consist of a simple integrating network for accepting the vertical rate incoming sync signal and developing an output, the magnitude of which is determinative of whether the input sync signal is negative-going or positive-going.

PROM 14 includes a plurality of addressable memory locations, at each of which digital data, in the form of a binary word, is stored. The stored information develops appropriate logic level signals at corresponding output terminals of PROM 14 in accordance with the addressed input terminals. For example, the logic level signal applied to the 16/64 mode select input terminal A7 determines two groups of memory locations. The logic level signals applied to the A6 and A8 input terminals, in combination, define four subgroups of memory locations. The video logic level signals at the A0–A5 input terminals define unique memory locations within these groups and subgroups. The horizontal blanking function, which is applicable to both the 16 and 64 color modes, overrides all video information. The BC signal need only be present in either the 16 or 64 color mode to activate this function. It should be appreciated that the PROM is addressed, and memory information read out, at a pixel rate with the binary word stored at each memory address supplying all necessary output information.

As mentioned, an appropriate logic level mode select signal, i.e., a "0" or "1" is supplied by vertical polarity detector 30 and indicates whether the accompanying video information is in a 16 or a 64 color format. The mode select signal supplied to the A7 input terminal of PROM 14 selects the appropriate one of the two main memory locations in the PROM.

For descriptive purposes, only the G processing means 22 will be described in detail. It will be appreciated by those skilled in the art that the circuit arrangements (and descriptions) for R processing means 18 and B processing means 20 are substantially identical to those for G processing means 22. G processing means 22 includes an NPN transistor 36 having a load resistor 38 connected between its collector and a source of +88 V d.c. potential and an emitter that is connected in common with the collectors of a pair of NPN transistors 42 and 44. A source of +8 V d.c. bias voltage is connected to the base of transistor 36 and its collector is connected to the G cathode of CRT 24. The emitter of transistor 36 is connected to a bias arrangement, consisting of a potentiometer 32 an a resistor 34, for adjusting the d.c. bias level on the G cathode of CRT 24. The emitter of transistor 42 is connected by a resistor 46 to ground and its base is connected to a potentiometer 50 and to the G output (terminal Q2) of PROM 14. As illustrated by the transistor 51, the internal PROM arrangement provides an open collector connected source for the G output logic level signal. Th emitter of transistor 44 is similarly connected to ground by a resistor 48 and its base is connected to the g output (terminal Q5) of PROM 14. Here again, a symbolic showing of a transistor 53 within PROM 14 indicates that the g logic level signal is supplied from an open collector source.

User adjustment means 26 includes a PNP transistor 60 and NPN transistors 72 and 80. Transistors 72 and 80 have their collectors connected to +8 V d.c. whereas the collector of transistor 60 is connected to ground. The base of transistor 60 is connected through a resistor 62 to the BC output (terminal Q8) of PROM 14 and, through a resistor 64, to a contrast potentiometer 66, connected between +5 V d.c. and ground. The base of transistor 60 is also coupled to an automatic brightness limiter (ABL) circuit (not shown). The emitter of transistor 60 is connected through a diode 61 and a resistor 70 to +8 V d.c., with the junction of diode 61 and resistor 70 being connected to the base of transistor 72. The depiction of a transistor 55 internally connected to terminal Q8 of PROM 14 indicates an open collector connection. The base of transistor 72 is also connected to an intensity potentiometer 82 that is connected to the base of transistor 80. The emitters of transistors 72 and 80 are connected to ground through resistors 74 and 84, respectively. The emitter of transistor 72 is connected to a resistor 52 in G processor means 22. Resistor 52 is in a voltage divider including potentiometer 50 and a resistor 54. The junction of resistor 52 and potentiometer 50 is connected to the Brown output (terminal Q7 ) of PROM 14 and the depiction of transistor 57 indicates an open collector connection. Finally, the emitter of transistor 80 is connected through a resistor 56 to the base of transistor 44.

In operation, it will be noted that the r, g and b input signals are not present when the I signal is present and vice versa. The I signal is equal to r+b+g, and therefore, in the 16 color mode, the r, g and b output signals from PROM 14 are equal and are either logic level "0" or "1" depending upon the I signal. In the 64 color mode, the r, g and b output signals are determined by r, g and b input signals. The G and g output signals from terminals Q2 and Q5 of PROM 14 are applied to the bases of transistors 42 and 44, respectively. The parallel connected transistors 42 and 44 are in a cascode arrangement with transistor 36 for applying an appropriate signal to the G cathode of CRT 24. The mode select input signal to terminal A7 determines the 16 or 64 color mode. The BC signal is activated to change the bias on the base of transistor 60 and thereby affect the analog contrast potential supplied through transistor 72 to the base of transistor 42, which processes the G signal. The change in conduction of transistor 60 also changes the base potential of transistor 80, which supplies the base of transistor 44 to affect processing of the g signal. Thus the contrast and intensity are altered together to change the overall brightness and contrast of the display. (It should be borne in mind that similar changes simultaneously occur in the R and B processing means 18 and 20.) Potentiometers 66 and 82 provide the user with manual controls for adjusting the contrast and intensity of the display to suit different preferences or conditions. It will also be appreciated that the emitter resistors of transistors 42 and 44 are part of frequency sensitive circuits (not shown) for enabling changes in conduction of transistor 42 to primarily affect G signal contrast and changes in conduction of transistor 44 to affect intensity changes in the G signal. During operation where the BC signal is not desired, the open collector construction of PROM 14 presents a very high impedance at terminal Q8 which, therefore, has no effect on operation of transistor 60. The open collector construction enables the outputs of the PROM to be connected across the low level inputs of the transistors.

As mentioned previously, in response to an appropriate user input from switch 12, the CRT displays can be changed to monochromatic green or amber (IBM brown) by addressing different memory locations to provide the required signals from the PROM outputs. During horizontal blanking periods, still other memory locations are accessed, where binary data for disabling all video output signals from PROM 14 are stored. In the case of IBM brown being selected at switch 12, output terminal Q7 is activated to reduce the G signal level applied to transistor 42 and reduce the intensity of the G cathode signal to effect a shift in color temperature of the display to produce Brown. Under other conditions, the open collector arrangement of terminal Q7 effectively removes the PROM circuitry from the input circuit of transistor 42.

The actual programming of the PROM is straightforward and a complete listing thereof is included as an appendix. The use of open collector connected output sources in the PROM enables a significant reduction of parts in providing these functions to be user.

It is recognized that numerous modifications and changes in the described embodiment of the invention will be apparent to those skilled in the art without departing from its true spirit and scope. The invention is to be limited only as defined in the claims.

APPENDIX

| HEX ADDRESS | HEX OUTPUT | HEX ADDRESS | HEX OUTPUT |
|---|---|---|---|
| 0000 | 40 | 0030 | 78 |
| 0001 | 41 | 0031 | 79 |
| 0002 | 42 | 0032 | 7A |
| 0003 | 03 | 0033 | 7B |
| 0004 | 44 | 0034 | 7C |
| 0005 | 45 | 0035 | 7D |
| 0006 | 46 | 0036 | 7E |
| 0007 | 47 | 0037 | 7F |
| 0008 | 40 | 0038 | 78 |
| 0009 | 41 | 0039 | 79 |
| 000A | 42 | 003A | 7A |
| 000B | 43 | 003B | 7B |
| 000C | 44 | 003C | 7C |
| 000D | 45 | 003D | 7D |
| 000E | 46 | 003E | 7E |
| 000F | 47 | 003F | 7F |
| 0010 | 78 | 0040 | 40 |
| 0011 | 79 | 0041 | 42 |
| 0012 | 7A | 0042 | 42 |
| 0013 | 7B | 0043 | 42 |
| 0014 | 7C | 0044 | 42 |
| 0015 | 7D | 0045 | 42 |
| 0016 | 7E | 0046 | 42 |
| 0017 | 7F | 0047 | 42 |
| 0018 | 78 | 0048 | 42 |
| 0019 | 79 | 0049 | 42 |
| 001A | 7A | 004A | 42 |
| 001B | 7B | 004B | 42 |
| 001C | 7C | 004C | 42 |
| 001D | 7D | 004D | 42 |
| 001E | 7E | 004E | 42 |
| 001F | 7F | 004F | 42 |
| 0020 | 40 | 0050 | 42 |
| 0021 | 41 | 0051 | 42 |
| 0022 | 42 | 0052 | 42 |
| 0023 | 43 | 0053 | 42 |
| 0024 | 44 | 0054 | 42 |
| 0025 | 45 | 0055 | 42 |
| 0026 | 46 | 0056 | 42 |
| 0027 | 47 | 0057 | 42 |
| 0028 | 40 | 0058 | 42 |
| 0029 | 41 | 0059 | 42 |
| 002A | 42 | 005A | 42 |
| 002B | 43 | 005B | 42 |
| 002C | 44 | 005C | 42 |
| 002D | 45 | 005D | 42 |
| 002E | 46 | 005E | 42 |
| 002F | 47 | 005F | 42 |
| 0060 | 42 | 008E | CE |
| 0061 | 42 | 008F | CF |

APPENDIX-continued

| | | | |
|---|---|---|---|
| 0062 | 42 | 0090 | D0 |
| 0063 | 42 | 0091 | D1 |
| 0064 | 42 | 0092 | D2 |
| 0065 | 42 | 0093 | D3 |
| 0066 | 42 | 0094 | D4 |
| 0067 | 42 | 0095 | D5 |
| 0068 | 42 | 0096 | D6 |
| 0069 | 42 | 0097 | D7 |
| 006A | 42 | 0098 | D8 |
| 006B | 42 | 0099 | D9 |
| 006C | 42 | 009A | DA |
| 006D | 42 | 009B | DB |
| 006E | 42 | 009C | DC |
| 006F | 42 | 009D | DD |
| 0070 | 42 | 009E | DE |
| 0071 | 42 | 009F | DF |
| 0072 | 42 | 00A0 | E0 |
| 0073 | 42 | 00A1 | E1 |
| 0074 | 42 | 00A2 | E2 |
| 0075 | 42 | 00A3 | E3 |
| 0076 | 42 | 00A4 | E4 |
| 0077 | 42 | 00A5 | E5 |
| 0078 | 42 | 00A6 | E6 |
| 0079 | 42 | 00A7 | E7 |
| 007A | 42 | 00A8 | E8 |
| 007B | 42 | 00A9 | E9 |
| 007C | 42 | 00AA | EA |
| 007D | 42 | 00AB | EB |
| 007E | 42 | 00AC | EC |
| 007F | 42 | 00AD | ED |
| 0080 | C0 | 00AE | EE |
| 0081 | C1 | 00AF | EF |
| 0082 | C2 | 00B0 | F0 |
| 0083 | C3 | 00B1 | F1 |
| 0084 | C4 | 00B2 | F2 |
| 0085 | C5 | 00B3 | F3 |
| 0086 | C6 | 00B4 | F4 |
| 0087 | C7 | 00B5 | F5 |
| 0088 | C8 | 00B6 | F6 |
| 0089 | C9 | 00B7 | F7 |
| 008A | CA | 00B8 | F8 |
| 008B | CB | 00B9 | F9 |
| 008C | CC | 00BA | FA |
| 008D | DC | 00BB | FB |
| 00BC | FC | 00EC | C2 |
| 00BD | FD | 00ED | C2 |
| 00BE | FE | 00EE | C2 |
| 00BF | FF | 00EF | C2 |
| 00C0 | C0 | 00F0 | C2 |
| 00C1 | C2 | 00F1 | C2 |
| 00C2 | C2 | 00F2 | C2 |
| 00C3 | C2 | 00F3 | C2 |
| 00C4 | C2 | 00F4 | C2 |
| 00C5 | C2 | 00F5 | C2 |
| 00C6 | C2 | 00F6 | C2 |
| 00C7 | C2 | 00F7 | C2 |
| 00C8 | C2 | 00F8 | C2 |
| 00C9 | C2 | 00F9 | C2 |
| 00CA | C2 | 00FA | C2 |
| 00CB | C2 | 00FB | C2 |
| 00CC | C2 | 00FC | C2 |
| 00CD | C2 | 00FD | C2 |
| 00CE | C2 | 00FE | C2 |
| 00CF | C2 | 00FF | C2 |
| 00D0 | C2 | 0100 | 00 |
| 00D1 | C2 | 0101 | 03 |
| 00D2 | C2 | 0102 | 03 |
| 00D3 | C2 | 0103 | 03 |
| 00D4 | C2 | 0104 | 03 |
| 00D5 | C2 | 0105 | 03 |
| 00D6 | C2 | 0106 | 03 |
| 00D7 | C2 | 0107 | 03 |
| 00D8 | C2 | 0108 | 03 |
| 00D9 | C2 | 0109 | 03 |
| 00DA | C2 | 010A | 03 |
| 00DB | C2 | 010B | 03 |
| 00DC | C2 | 010C | 03 |
| 00DD | C2 | 010D | 03 |
| 00DE | C2 | 010E | 03 |
| 00DF | C2 | 010F | 03 |
| 00E0 | C2 | 0110 | 03 |
| 00E1 | C2 | 0111 | 03 |

APPENDIX-continued

| | | | |
|---|---|---|---|
| 00E2 | C2 | 0112 | 03 |
| 00E3 | C2 | 0113 | 03 |
| 00E4 | C2 | 0114 | 03 |
| 00E5 | C2 | 0115 | 03 |
| 00E6 | C2 | 0116 | 03 |
| 00E7 | C2 | 0117 | 03 |
| 00E8 | C2 | 0118 | 03 |
| 00E9 | C2 | 0119 | 03 |
| 00EA | C2 | 011A | 03 |
| 00EB | C2 | 011B | 03 |
| 011C | 03 | 014A | 00 |
| 011D | 03 | 014B | 00 |
| 011E | 03 | 014C | 00 |
| 011F | 03 | 014D | 00 |
| 0120 | 03 | 014E | 00 |
| 0121 | 03 | 014F | 00 |
| 0122 | 03 | 0150 | 00 |
| 0123 | 03 | 0151 | 00 |
| 0124 | 03 | 0152 | 00 |
| 0125 | 03 | 0153 | 00 |
| 0126 | 03 | 0154 | 00 |
| 0127 | 03 | 0155 | 00 |
| 0128 | 03 | 0156 | 00 |
| 0129 | 03 | 0157 | 00 |
| 012A | 03 | 0158 | 00 |
| 012B | 03 | 0159 | 00 |
| 012C | 03 | 015A | 00 |
| 012D | 03 | 015B | 00 |
| 012E | 03 | 015C | 00 |
| 012F | 03 | 015D | 00 |
| 0130 | 03 | 015E | 00 |
| 0131 | 03 | 015F | 00 |
| 0132 | 03 | 0160 | 00 |
| 0133 | 03 | 0161 | 00 |
| 0134 | 03 | 0162 | 00 |
| 0135 | 03 | 0163 | 00 |
| 0136 | 03 | 0164 | 00 |
| 0137 | 03 | 0165 | 00 |
| 0138 | 03 | 0166 | 00 |
| 0139 | 03 | 0167 | 00 |
| 013A | 03 | 0168 | 00 |
| 013B | 03 | 0169 | 00 |
| 013C | 03 | 016A | 00 |
| 013D | 03 | 016B | 00 |
| 013E | 03 | 016C | 00 |
| 013F | 03 | 016D | 00 |
| 0140 | 00 | 016E | 00 |
| 0141 | 00 | 016F | 00 |
| 0142 | 00 | 0170 | 00 |
| 0143 | 00 | 0171 | 00 |
| 0144 | 00 | 0172 | 00 |
| 0145 | 00 | 0173 | 00 |
| 0146 | 00 | 0174 | 00 |
| 0147 | 00 | 0175 | 00 |
| 0148 | 00 | 0176 | 00 |
| 0149 | 00 | 0177 | 00 |
| 0178 | 00 | 01A7 | 83 |
| 0179 | 00 | 01A8 | 83 |
| 017A | 00 | 01A9 | 83 |
| 017B | 00 | 01AA | 83 |
| 017C | 00 | 01AB | 83 |
| 017D | 00 | 01AC | 83 |
| 017E | 00 | 01AD | 83 |
| 017F | 00 | 01AE | 83 |
| 0180 | 80 | 01AF | 83 |
| 0181 | 83 | 01B0 | 83 |
| 0182 | 83 | 01B1 | 83 |
| 0183 | 83 | 01B2 | 83 |
| 0184 | 83 | 01B3 | 83 |
| 0185 | 83 | 01B4 | 83 |
| 0186 | 83 | 01B5 | 83 |
| 0187 | 83 | 01B6 | 83 |
| 0188 | 83 | 01B7 | 83 |
| 0189 | 83 | 01B8 | 83 |
| 018A | 83 | 01B9 | 83 |
| 018B | 83 | 01BA | 83 |
| 018C | 83 | 01BB | 83 |
| 018D | 83 | 01BC | 83 |
| 018E | 83 | 01BD | 83 |
| 018F | 83 | 01BE | 83 |
| 0190 | 83 | 01BF | 83 |
| 0191 | 83 | 01C0 | 00 |

APPENDIX-continued

| | | | |
|---|---|---|---|
| 0192 | 83 | 01C1 | 00 |
| 0193 | 83 | 01C2 | 00 |
| 0194 | 83 | 01C3 | 00 |
| 0195 | 83 | 01C4 | 00 |
| 0196 | 83 | 01C5 | 00 |
| 0197 | 83 | 01C6 | 00 |
| 0198 | 83 | 01C7 | 00 |
| 0199 | 83 | 01C8 | 00 |
| 019A | 83 | 01C9 | 00 |
| 019B | 83 | 01CA | 00 |
| 019C | 83 | 01CB | 00 |
| 019D | 83 | 01CC | 00 |
| 019E | 83 | 01CD | 00 |
| 019F | 83 | 01CE | 00 |
| 01A0 | 83 | 01CF | 00 |
| 01A1 | 83 | 01D0 | 00 |
| 01A2 | 83 | 01D1 | 00 |
| 01A3 | 83 | 01D2 | 00 |
| 01A4 | 83 | 01D3 | 00 |
| 01A5 | 83 | 01D4 | 00 |
| 01A6 | 83 | 01D5 | 00 |

| HEX ADDRESS | HEX OUTPUT |
|---|---|
| 01D6 | 00 |
| 01D7 | 00 |
| 01D8 | 00 |
| 01D9 | 00 |
| 01DA | 00 |
| 01DB | 00 |
| 01DC | 00 |
| 01DD | 00 |
| 01DE | 00 |
| 01DF | 00 |
| 01E0 | 00 |
| 01E1 | 00 |
| 01E2 | 00 |
| 01E3 | 00 |
| 01E4 | 00 |
| 01E5 | 00 |
| 01E6 | 00 |
| 01E7 | 00 |
| 01E8 | 00 |
| 01E9 | 00 |
| 01EA | 00 |
| 01EB | 00 |
| 01EC | 00 |
| 01ED | 00 |
| 01EE | 00 |
| 01EF | 00 |
| 01F0 | 00 |
| 01F1 | 00 |
| 01F2 | 00 |
| 01F3 | 00 |
| 01F4 | 00 |
| 01F5 | 00 |
| 01F6 | 00 |
| 01F7 | 00 |
| 01F8 | 00 |
| 01F9 | 00 |
| 01FA | 00 |
| 01FB | 00 |
| 01FC | 00 |
| 01FD | 00 |
| 01FE | 00 |
| 01FF | 00 |
| 1000 | 00 |

What is claimed is:

1. A video processing system comprising:

means selectively providing a first and a second plurality of address signals, corresponding to two groups of logic level color video input signals including R, B, G and I, and R, B, G, r, b and g and a logic level control signal, respectively;

PROM means having a plurality of memory locations addressable by said plurality of address signals for developing corresponding open collector logic level color video output signals including R, G, B, r, g, and b;

amplifier means including Red, Green and Blue amplifiers supplied with said R, r; B, b; and G, g logic level color video output signals, respectively and producing analog signals therefrom; and said PROM developing a brightness compensation signal for altering the magnitude of said analog signals as a function of said control signal.

2. The system of claim 1 further including compensation means, responsive to said brightness compensation signal, for changing the effective magnitude of said r, g and b signals applied to said Red, Green and Blue amplifiers.

3. The system of claim 2, further including; user operable color and tint means coupled to said Red, Green and Blue amplifiers.

4. The system of claim 2, further including input blanking control signals to said PROM for addressing memory locations during blanking periods for disabling said logic level color video output signals.

5. The system of claim 4 wherein said input blanking control signals provide multiplexed information relating to monochromatic display and video blanking.

6. The system of claim 4, further including multi-position switch means coupled to at least one input of said PROM for changing the memory locations addressed by said logic level color video input signals for changing said outputs.

7. A color video monitor, including a cathode ray tube, operable in two different color modes comprising:

means for receiving first and second pluralities of logic level input signals corresponding to said two different color modes, respectively, and including color video signals and at least one function signal defining said two different color modes, said first plurality of logic level input signals including R, B, G and I and said second plurality of logic level input signals including R, B, G, r, b and g;

PROM means having individual memory locations addressable by said input signals for supplying a plurality of open collector logic level video output signals, including R, G, B, r, g and b, in response thereto;

means responsive to said function signal for changing the memory locations addressed by said input signals; and a plurality of analog Red, Green and Blue output video amplifier means coupled to receive said plurality of logic level video output signals for supplying color video output signals to said cathode ray tube.

8. The system of claim 7 wherein said PROM includes binary words at said memory locations for defining said open collector logic level video output signals responsive to said pluralities of input signals.

* * * * *